US012345449B2

(12) United States Patent
Regnat et al.

(10) Patent No.: US 12,345,449 B2
(45) Date of Patent: Jul. 1, 2025

(54) ADIABATIC DEMAGNETIZATION APPARATUS

(71) Applicant: KIUTRA GMBH, Munich (DE)

(72) Inventors: Alexander Regnat, Munich (DE); Jan Spallek, Munich (DE)

(73) Assignee: KIUTRA GMBH, Munich (DE)

( * ) Notice: Subject to any disclaimer, the term of this patent is extended or adjusted under 35 U.S.C. 154(b) by 436 days.

(21) Appl. No.: 17/626,166

(22) PCT Filed: Jul. 13, 2020

(86) PCT No.: PCT/EP2020/069792
§ 371 (c)(1),
(2) Date: Jan. 11, 2022

(87) PCT Pub. No.: WO2021/009139
PCT Pub. Date: Jan. 21, 2021

(65) Prior Publication Data

US 2022/0316768 A1 Oct. 6, 2022

(30) Foreign Application Priority Data

Jul. 15, 2019 (DE) ..... 10 2019 119 092.4

(51) Int. Cl.
*F25B 21/00* (2006.01)
*F25B 9/14* (2006.01)
*F25D 19/00* (2006.01)

(52) U.S. Cl.
CPC ..... *F25B 21/00* (2013.01); *F25B 9/145* (2013.01); *F25D 19/006* (2013.01); *F25B 2321/0021* (2013.01)

(58) Field of Classification Search
CPC .. F25B 21/00; F25B 9/145; F25B 2321/0021; F25D 19/006
See application file for complete search history.

(56) References Cited

U.S. PATENT DOCUMENTS 3,119,236 A 1/1964 Lutes
2005/0230097 A1* 10/2005 Shirron ..... F25D 19/006 165/300
2013/0186107 A1* 7/2013 Shih ..... F25B 21/00 62/3.1

(Continued)

FOREIGN PATENT DOCUMENTS

JP 2007-255746 A 10/2007
JP 2013-57410 A 3/2013

(Continued)

OTHER PUBLICATIONS

Chinese Office Action dated Feb. 11, 2023 received in Chinese Application No. 202080061336.2, together with an English-language translation.

(Continued)

*Primary Examiner* — Larry L Furdge
*Assistant Examiner* — Keith Stanley Myers
(74) *Attorney, Agent, or Firm* — Scully, Scott, Murphy & Presser, P.C.

(57) ABSTRACT

The present disclosure is to a method of controlling an adiabatic demagnetization apparatus. The method includes varying at least one operation parameter of the adiabatic demagnetization apparatus.

11 Claims, 5 Drawing Sheets

(56) References Cited

U.S. PATENT DOCUMENTS

2013/0305742 A1 11/2013 Wu et al.

FOREIGN PATENT DOCUMENTS

JP 2013-185795 A 9/2013
JP 2015-31472 A 2/2015

OTHER PUBLICATIONS

International Search Report and Written Opinion dated Oct. 12, 2020 received in International Application No. PCT/EP2020/069792.
Japanese Notification of Reasons for Refusal dated Feb. 22, 2023 received in Japanese Application No. 2021-576935, together with an English-language translation.

* cited by examiner

ADIABATIC DEMAGNETIZATION APPARATUS

FIELD

The present disclosure relates to a method of controlling an adiabatic demagnetization apparatus and an adiabatic demagnetization apparatus. The present disclosure particularly relates to a method of controlling a multi-stage adiabatic demagnetization apparatus within a predetermined temperature range.

BACKGROUND

A cryostat is generally used to maintain low temperatures of samples mounted within the cryostat. Low temperatures may be achieved by using, for example, a cryogenic fluid bath such as liquid helium. However, the cooling medium, such as liquid helium, continuously evaporates due to external and/or internal heat input in the cryostat and therefore needs to be refilled regularly. This requires considerable time and resources, whereby the operating costs of such cryostats are high.

In order to overcome the above drawbacks, cryogen-free cryostats have been developed. Cryogen-free cryostats may employ a cryogen-free closed cycle system, such a pulse tube cryocooler. Modern pulse tube cryocoolers can achieve temperatures down to 1.2 K. In order to achieve sub-Kelvin temperatures, a magnetic cooling stage can be used in addition to the cryogen-free closed cycle system. The magnetic cooling stage may be an adiabatic demagnetization refrigerator (ADR), which can achieve temperatures down to a few milli-Kelvin. ADR is based on the magneto-caloric effect. When a medium is magnetized its magnetic moments get aligned and the heat of magnetization is released. Vice versa, if the medium is demagnetized its temperature drops.

Conventional ADR systems are operated in single-shot mode. This means that low temperatures are achieved only for a short time and are not maintained stably for a longer time. However, in many applications it is considered beneficial to maintain low temperatures e.g. in the sub-Kelvin range for a long time and in a stable manner.

In view of the above, new methods of controlling an adiabatic demagnetization apparatus and adiabatic demagnetization apparatuses that overcome at least some of the problems in the art are beneficial.

SUMMARY

In light of the above, a method of controlling an adiabatic demagnetization apparatus, a non-transitory machine readable medium, a controller, an adiabatic demagnetization apparatus, and a cryostat are provided.

It is an object of the present disclosure to provide a method of controlling an adiabatic demagnetization apparatus, a non-transitory machine readable medium, a controller, an adiabatic demagnetization apparatus, and a cryostat, which can continuously and variably achieve low temperatures, in particular in the sub-Kelvin range. Further aspects, benefits, and features of the present disclosure are apparent from the claims, the description, and the accompanying drawings.

According to an independent aspect of the present disclosure, a method of controlling an adiabatic demagnetization apparatus is provided. The method includes varying at least on operational parameter of the adiabatic demagnetization apparatus.

According to some embodiments, which can be combined with other embodiments described herein, the at least one operational parameter is selected from the group including, or consisting of, a cycling frequency of at least one adiabatic demagnetization unit, a switching mode of a plurality of thermal switches, and at least one of a maximum cycling temperature and a minimum cycling temperature of at least one adiabatic demagnetization unit.

According to an independent aspect of the present disclosure, a method of controlling an adiabatic demagnetization apparatus is provided. The method includes: (i) cycling at least one adiabatic demagnetization unit of the adiabatic demagnetization apparatus between a first temperature and a second temperature with varying frequency; and/or (ii) operating a plurality of thermal switches of the adiabatic demagnetization apparatus in a first switching mode if a first target temperature is set and/or a first heat load is applied, and operating the plurality of thermal switches in a second switching mode if a second target temperature is set and/or a second heat load is applied; and/or cycling at least one adiabatic demagnetization unit of the adiabatic demagnetization apparatus between a first temperature and a second temperature, wherein the first temperature and/or the second temperature is varied or variable.

According to an independent aspect of the present disclosure, a method of controlling an adiabatic demagnetization apparatus is provided. The method includes cycling at least one adiabatic demagnetization unit of the adiabatic demagnetization apparatus between a first temperature and a second temperature with varying frequency.

According to some embodiments, which can be combined with other embodiments described herein, the frequency is varied over time.

According to some embodiments, which can be combined with other embodiments described herein, the frequency is varied based on a heat load.

According to some embodiments, which can be combined with other embodiments described herein, the frequency is increased when the heat load increases and/or wherein the frequency is decreased when the heat load decreases.

According to some embodiments, which can be combined with other embodiments described herein, the first temperature is higher than the second temperature.

According to some embodiments, which can be combined with other embodiments described herein, the adiabatic demagnetization apparatus includes a total number n of adiabatic demagnetization units, wherein $n \geq 1$, 2 or 3.

According to some embodiments, which can be combined with other embodiments described herein, the n adiabatic demagnetization units are connectable in series.

According to some embodiments, which can be combined with other embodiments described herein, the n adiabatic demagnetization units are connectable in series by thermal switches.

According to some embodiments, which can be combined with other embodiments described herein, a number m of adiabatic demagnetization units of the n adiabatic demagnetization units is cycled between respective first temperatures and second temperatures, wherein $m \leq n$, in particular wherein $m=n-1$.

According to some embodiments, which can be combined with other embodiments described herein, the frequency is varied based on a heat load applied to a last stage n of the n adiabatic demagnetization units.

According to an independent aspect of the present disclosure, a method of controlling an adiabatic demagnetization apparatus is provided. The method includes operating a plurality of thermal switches of the adiabatic demagnetization apparatus in a first switching mode if a first target temperature is set and/or a first heat load is applied; and operating the plurality of thermal switches in a second switching mode if a second target temperature is set and/or a second heat load is applied.

According to some embodiments, which can be combined with other embodiments described herein, the first switching mode is different from the second switching mode.

According to some embodiments, which can be combined with other embodiments described herein, the first target temperature is different from the second target temperature and/or the first heat load is different from the second heat load.

According to some embodiments, which can be combined with other embodiments described herein, the plurality of thermal switches includes a total number a of thermal switches, wherein $a \geq 2$.

According to some embodiments, which can be combined with other embodiments described herein, a number b of the a thermal switches is operated in the first switching mode, and a number c of the a thermal switches is operated in the second switching mode, wherein $b \neq c$.

According to some embodiments, which can be combined with other embodiments described herein, thermal switches, which are not operated in the first switching mode and/or the second switching mode, are closed.

According to some embodiments, which can be combined with other embodiments described herein, more thermal switches are operated when the target temperature is changed to a lower target temperature and/or when a heat load increases.

Additionally, or alternatively, less thermal switches are operated when the target temperature is changed to a higher target temperature and/or when a heat load decreases.

According to some embodiments, which can be combined with other embodiments described herein, the method further includes cycling at least one adiabatic demagnetization unit of the adiabatic demagnetization apparatus between a first temperature and a second temperature with varying frequency.

According to an independent aspect of the present disclosure, a method of controlling an adiabatic demagnetization apparatus is provided. The method includes cycling at least one adiabatic demagnetization unit of the adiabatic demagnetization apparatus between a first temperature and a second temperature, wherein the first temperature and/or the second temperature is varied or variable.

According to some embodiments, which can be combined with other embodiments described herein, the first temperature is higher than the second temperature.

According to some embodiments, which can be combined with other embodiments described herein, the first temperature and/or the second temperature is varied based on a heat load and/or a target temperature.

According to some embodiments, which can be combined with other embodiments described herein, the first temperature and/or the second temperature is decreased if the heat load is increased, and/or the first temperature and/or the second temperature is increased if the target temperature is increased.

According to some embodiments, which can be combined with other embodiments described herein, the first temperature and/or the second temperature is increased if the heat load is decreased, and/or the first temperature and/or the second temperature is decreased of the target temperature is decreased.

According to some embodiments, which can be combined with other embodiments described herein, based on a change of the heat load and/or the target temperature, both of the first temperature and the second temperature can be increased or decreased, or the first temperature can be increased and the second temperature can be decreased, or the first temperature can be decreased and the second temperature can be increased.

According to some embodiments, which can be combined with other embodiments described herein, the cycling of the at least one adiabatic demagnetization unit of the adiabatic demagnetization apparatus between the first temperature and the second temperature includes: cycling the at least one adiabatic demagnetization unit of the adiabatic demagnetization apparatus between the first temperature and the second temperature with varying frequency.

According to some embodiments, which can be combined with other embodiments described herein, the method further includes: operating a plurality of thermal switches of the adiabatic demagnetization apparatus in a first switching mode if a first target temperature is set; and operating the plurality of thermal switches in a second switching mode if a second target temperature is set.

According to an independent aspect of the present disclosure, a machine readable medium (e.g. a memory) is provided. The machine readable medium includes instructions executable by one or more processors to implement the embodiments of the method of the present disclosure.

According to an independent aspect of the present disclosure, a controller is provided. The controller includes one or more processors and a memory coupled to the one or more processors and comprising instructions executable by the one or more processors to implement the embodiments of the method of the present disclosure.

According to an independent aspect of the present disclosure, an adiabatic demagnetization apparatus is provided. The adiabatic demagnetization apparatus includes the controller.

According to an independent aspect of the present disclosure, a cryostat is provided, including the adiabatic demagnetization apparatus.

Embodiments are also directed at apparatuses for carrying out the disclosed methods and include apparatus parts for performing each described method aspect. These method aspects may be performed by way of hardware components, a computer programmed by appropriate software, by any combination of the two or in any other manner. Furthermore, embodiments according to the disclosure are also directed at methods for operating the described apparatus. It includes method aspects for carrying out every function of the apparatus.

BRIEF DESCRIPTION OF THE DRAWINGS

So that the manner in which the above recited features of the present disclosure can be understood in detail, a more particular description of the disclosure, briefly summarized above, may be had by reference to embodiments. The accompanying drawings relate to embodiments of the disclosure and are described in the following.

DETAILED DESCRIPTION OF EMBODIMENTS

Reference will now be made in detail to the various embodiments of the disclosure, one or more examples of which are illustrated in the figures. Within the following description of the drawings, the same reference numbers refer to same components. Generally, only the differences with respect to individual embodiments are described. Each example is provided by way of explanation of the disclosure and is not meant as a limitation of the disclosure. Further, features illustrated or described as part of one embodiment can be used on or in conjunction with other embodiments to yield yet a further embodiment. It is intended that the description includes such modifications and variations.

Figure 1:
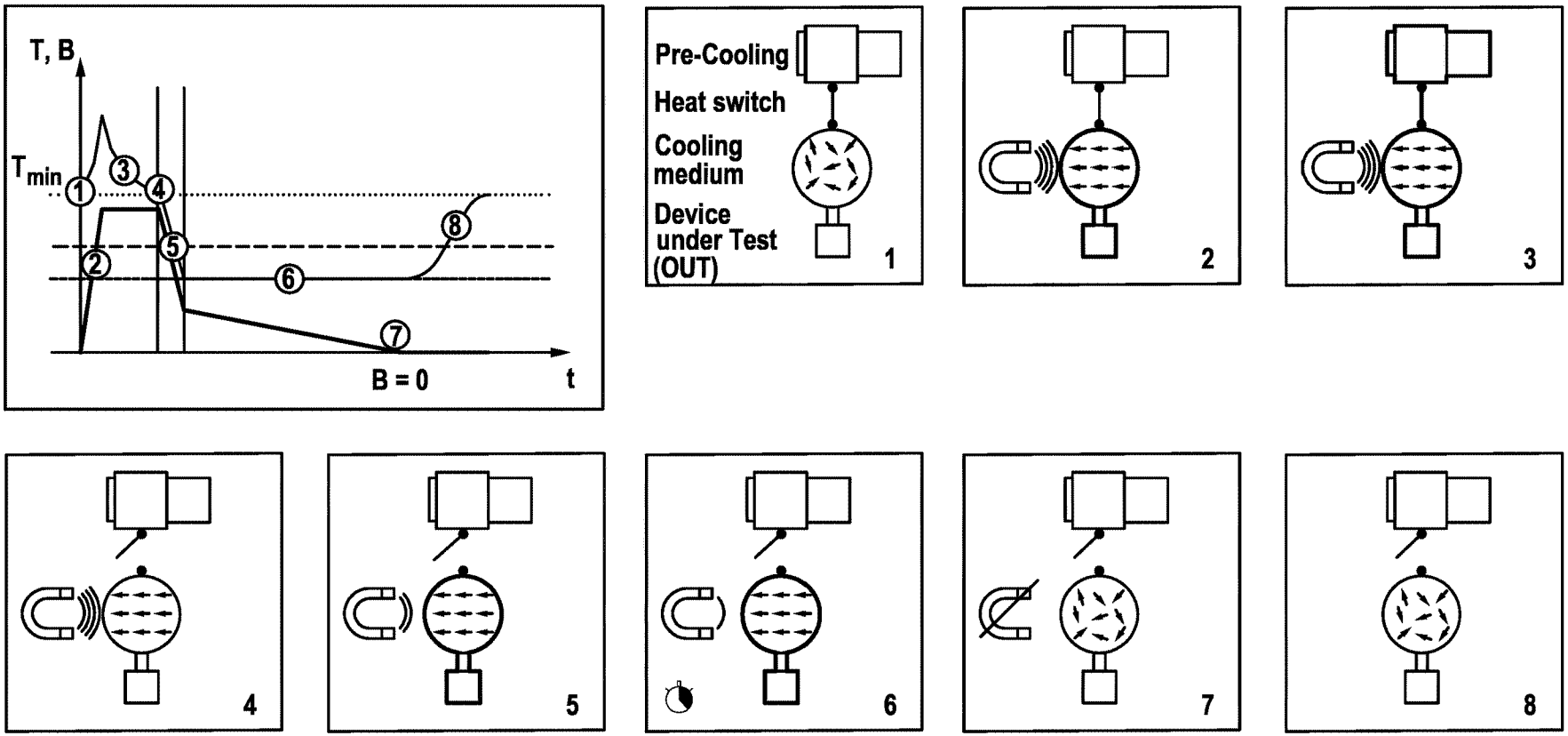
FIG. 1 shows an operation principle of an adiabatic demagnetization refrigerator.

FIG. 1 shows an operation principle of an adiabatic demagnetization refrigerator.

Adiabatic demagnetization refrigeration (ADR) is a cooling method which uses the entropy-dependence of a paramagnetic spin system (e.g. the magnetic moments due to the electronic orbital motion and electron spin, or nuclear spins) to provide low-temperature or ultra-low temperature cooling. The method allows to generate low or ultra-low temperatures of some milli-Kelvin or even some micro-Kelvin. An exemplary implementation of ADR makes use of a single ADR unit which includes a heat switch, a cooling medium, and a magnet. Low or ultra-low temperatures are generated by demagnetizing the cooling medium. An exemplary cooling procedure is shown in more detail in FIG. 1.

In box 1 of FIG. 1, the heat switch is closed, and the cooling medium is coupled to a pre-cooling unit. In box 2, a local magnetic field is increased to maximum and heat of magnetization is released, whereby the sample is heated. In box 3, thermalization takes place and the heat of magnetization is removed by means of the pre-cooling unit. In box 4, the heat switch is open, and the magnetic field is still applied. In box 5, the magnetic field is reduced, and the sample is cooled. In box 6, the sample temperature is constant, and the magnetic field is decreased. In box 7, the magnetic field is zero and the cooling process terminates. In box 8, the cooling medium regenerates and the sample warms up to base temperature.

ADR can be operated in a single-shot mode, e.g. using a single ADR unit. The single-shot mode can achieve low temperatures only short-term and not continuously. Such a short-term cooling may limit the use and commercial application of ADR. Instead, He-3 based techniques, such as dilution refrigerators, are often used for providing sub-Kelvin temperatures in a continuous manner.

Figure 2:
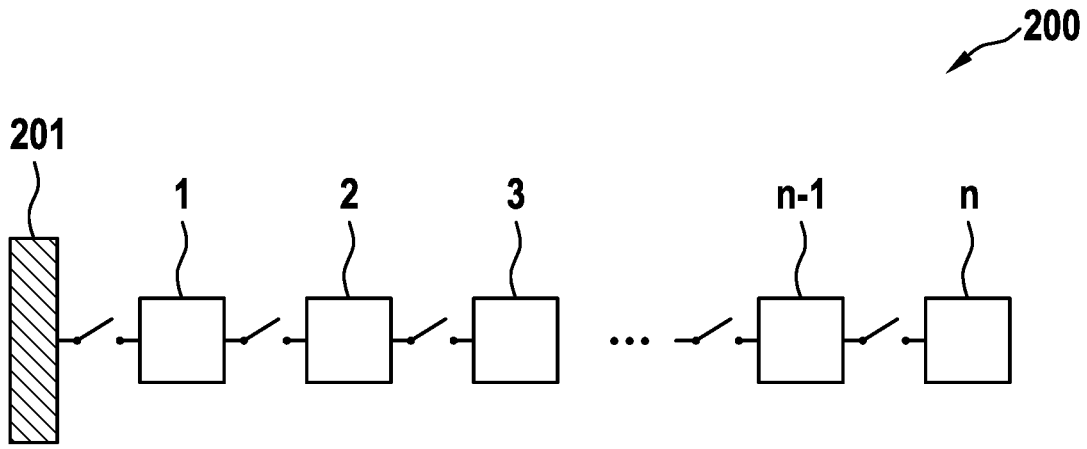
FIG. 2 shows a schematic view of a multi-stage adiabatic demagnetization refrigerator.

FIG. 2 shows a schematic view of multi-stage adiabatic demagnetization refrigerator 200.

The drawbacks of short-time cooling with ADR may be solved by using multi-stage ADR, i.e., refrigerators which have two or more mutually connected ADR units. FIG. 2 illustrates multi-stage ADR where n ADR units are connected as a chain. By dissipating the heat of magnetization of ADR unit n in ADR unit n−1 it is possible to provide a residual magnetic field and hence cooling power at the last ADR unit n. Besides the simple chain schematically illustrated in FIG. 2, more complex configurations of multi-stage ADR including e.g. multiple ADR chains, each having multiple ADR units, can be provided, wherein the ADR chains may be operated in parallel or in series.

A first ADR unit ("1" in FIG. 2) of the multiple ADR units can be connected to a heat sink 201. The heat sink 201 can be provided by a cryogen-free closed cycle system, such a pulse tube cryocooler. The heat sink 201 can be maintained at an essentially constant temperature e.g. in a range between 1K and 4K. For example, the heat sink 201 can be maintained at an essentially constant temperature of about 4K.

Multi-stage ADR can be used to realize continuous magnetic refrigeration, i.e., to provide a cryogenic temperature $T_{target}$ for arbitrary long temperatures by means of ADR. This technique is sometimes referred to as CADR (continuous adiabatic demagnetization refrigeration). CADR is particularly useful because low temperatures are generated permanently without the use of liquid cooling media (i.e., cryogens). Particularly, no liquid Helium-4 or Helium-3 is needed.

Figure 3:
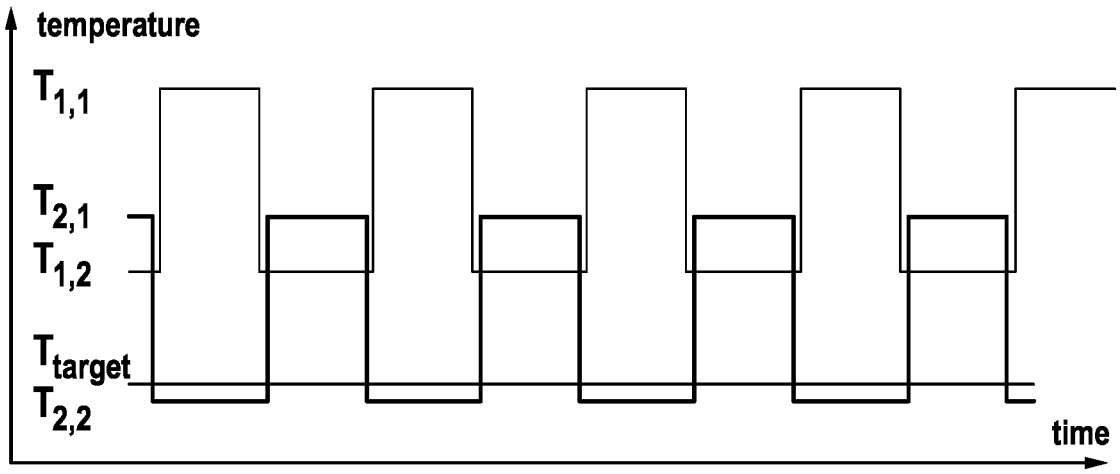
FIG. 3 shows a time-temperature profile of a multi-stage adiabatic demagnetization refrigerator.

FIG. 3 shows a time-temperature profile of the multi-stage adiabatic demagnetization refrigerator of FIG. 2.

Each individual ADR unit with index $i<n$ is operated between two different temperatures $T_{i,1}$ and $T_{i,2}$, $T_{i,1}>T_{i,2}$, wherein $T_{i,1}$ is a temperature provided by a heat bath, e.g., another ADR unit (e.g. n−1), and $T_{i,2}$ is a temperature provided by the ADR unit by means of demagnetization cooling. Thereby, the temperatures $T_{i,1}$ and $T_{i,2}$ are chosen such as to provide optimum cooling of the last, $n^{th}$ ADR unit operated at a single, constant temperature, the target temperature $T_{n,1}=T_{n,2}=T_n=T_{target}$ of the overall multi-stage assembly, wherein $T_{target}>T_{n-1,2}$. For each individual ADR unit, a transition from $T_{n,1}$ to $T_{n,2}$ and back from $T_{n,2}$ to $T_{n,1}$ is carried out repeatedly at a constant rate ("recycling rate"), wherein the latter may be chosen to optimize the cooling of the last, $n^{th}$ ADR unit at the target temperature $T_{target}$. The operation scheme in FIG. 3 is schematically illustrated for a 3-stage CADR system.

This implementation of a magnetic heat pump suffers from several limitations, particularly:

- Only one single target temperature can be achieved with high efficiency.
- The magnetic heat pump only provides a fixed cooling power but cannot react to changes of the heat load.
- The target temperature cannot be changed continuously during operation of the magnetic heat pump without additional means, such as a resistive heater.
- The operation of the magnetic heat pump at temperatures far above $T_{Target}$ is prohibited because the $n^{th}$ ADR unit needs to be optimized for the operation at $T_{target}$, i.e., it makes use of a specific cooling medium, magnetic field strength B, bath temperature and recycling rate which prohibit the generation of temperatures well above $T_{Target}$.
- The same switching noise is generated by the heat switches even at very low heat load because the heat pump is operated using constant recycling rates, hence reducing the temperature stability.
- The same stress is applied to the heat switches even at very low heat loads because the heat pump is operated using constant recycling rates, hence reducing the heat switch lifetime.

Figure 4:
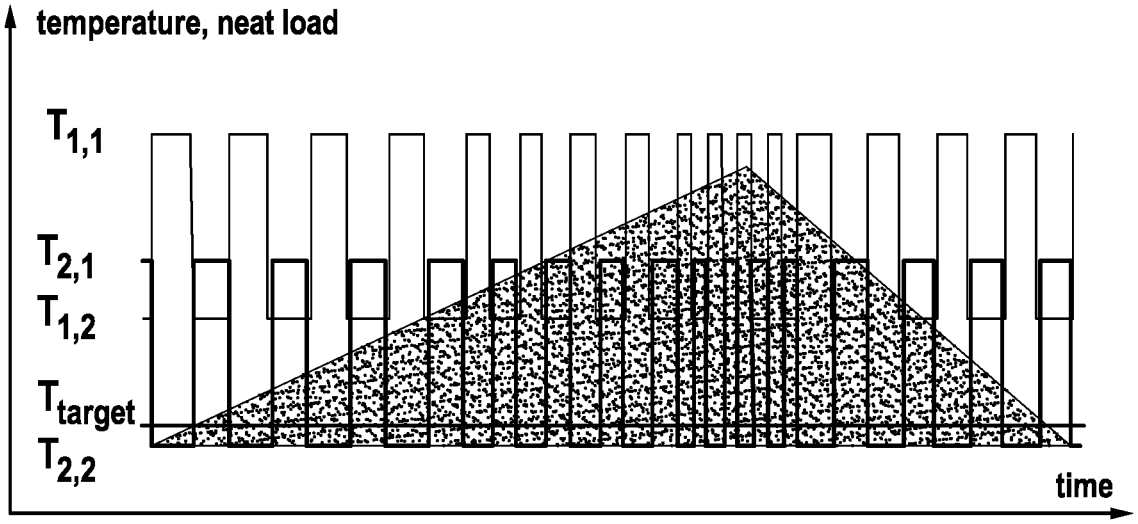
FIG. 4 shows a time-temperature profile of a multi-stage adiabatic demagnetization refrigerator according to embodiments of the present disclosure.
Figure 5:
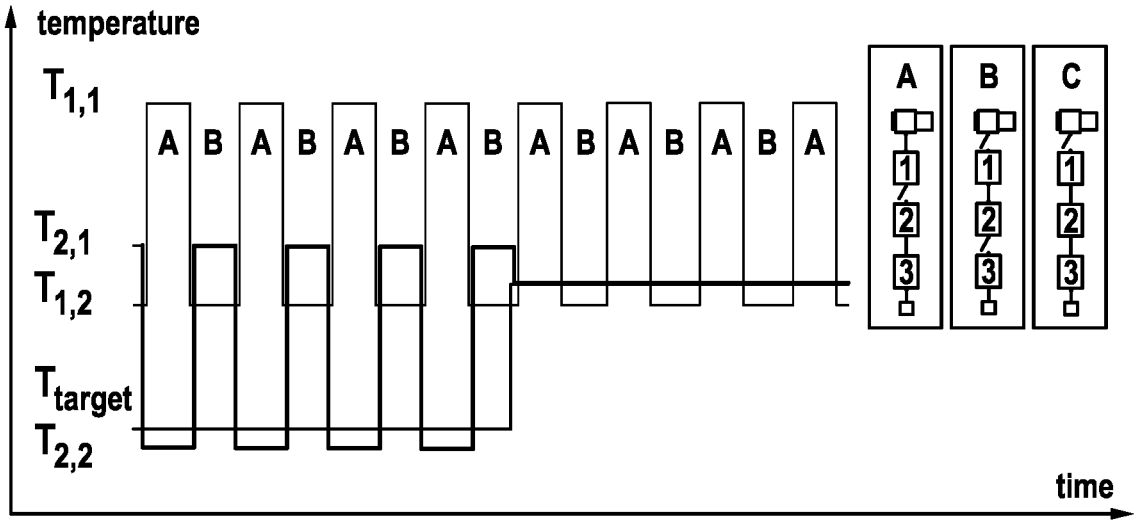
FIG. 5 shows a time-temperature profile of a multi-stage adiabatic demagnetization refrigerator according to further embodiments of the present disclosure.
Figure 6:
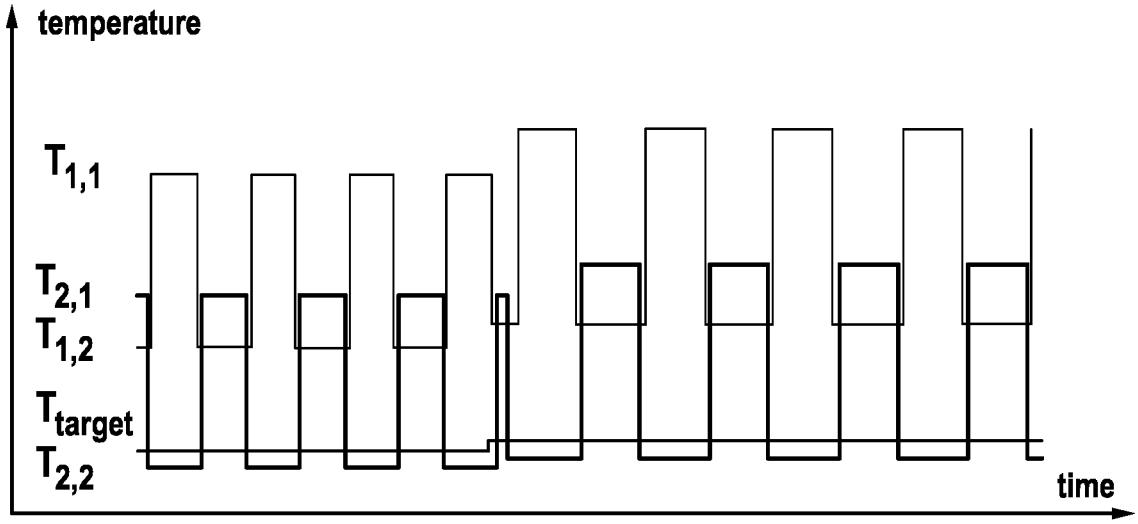
FIG. 6 shows a time-temperature profile of a multi-stage adiabatic demagnetization refrigerator according to yet further embodiments of the present disclosure.

FIGS. 4 to 6 show time-temperature profiles of a multi-stage adiabatic demagnetization refrigerator according to embodiments of the present disclosure.

The embodiments of the present disclosure overcome the above-mentioned limitations and allow to stabilize arbitrary target temperatures between $T_{1,1}$ and $T_n$ magnetically and at very high precision, and to cope with changes of the heat load applied to the magnetic heat pump, thereby also reducing thermal switching noise and heat switch stress at low heat loads. This is achieved by a method of controlling an adiabatic demagnetization apparatus which includes varying at least one operational parameter of the adiabatic demagnetization apparatus.

FIGS. 4 to 6 show implementations of the above general concept of varying at least operation parameter of the adiabatic demagnetization apparatus.

The adiabatic demagnetization apparatus includes at least one adiabatic demagnetization unit, and in particular a plurality of adiabatic demagnetization units to implement ADR or CADR.

Each individual ADR unit includes a paramagnetic cooling medium, a magnet device configured to provide and remove a magnetic field at the position of the paramagnetic cooling medium, and a thermal switch. The magnet device can include, or be, an electromagnet, such as a resistive or superconducting electromagnet, having a magnet power supply connected thereto. The thermal switch, which may also be referred to as "heat switch", is configured to connect and disconnect the paramagnetic cooling medium from a heat bath. The heat bath may be a main thermal bath (e.g. the heat sink 201 in FIG. 2) or another ADR unit.

In some implementations, a temperature of each individual ADR unit is measured using a temperature sensor, such as a low-temperature sensor. The low-temperature sensor may be a resistive NTC thermometer but is not limited thereto.

FIG. 4 shows a time-temperature profile of a multi-stage adiabatic demagnetization refrigerator according to embodiments of the present disclosure, wherein the CADR system is operated at variable frequencies (also referred to as "cycling frequencies" or "recycling rates").

According to a first aspect of the present disclosure, the method of controlling an adiabatic demagnetization apparatus includes cycling at least one adiabatic demagnetization unit of the adiabatic demagnetization apparatus between a first temperature and a second temperature with varying frequency.

Accordingly, the method of the first aspect uses non-constant recycling rates. The grey shaded triangular area in FIG. 4 illustrates an exemplary heat load applied to the ADR system. At high heat load, the ADR system is operated at high recycling rates to provide continuous low-temperature magnetic cooling. At low heat load, the recycling rate is decreased, thereby reducing the number of switching procedures and the thermal switching noise, and increasing the lifetime of the heat switches.

The first temperature ($T_{i,1}$) may also be referred to as "first operating temperature" or "upper operating temperature". The second temperature ($T_{i,2}$) may also be referred to as "second operating temperature" or "lower operating temperature". The first temperature is higher than the second temperature, i.e., $T_{i,1}>T_{i,2}$.

The term "target temperature" as used throughout the present disclosure relates to a set temperature which is to be achieved and stably maintained and/or controlled by the ADR system. The target temperature may be a temperature of a sample stage of the ADR system. For example, the target temperature can be a temperature of the $n^{th}$ adiabatic demagnetization unit, which may be a last stage of the chain of adiabatic demagnetization units. The last stage can be connected to a sample stage of the adiabatic demagnetization apparatus.

In some implementations, the adiabatic demagnetization apparatus is configured to control the target temperature within a predetermined temperature range. The predetermined temperature range may be 5 mK to 0.5K, particularly 5 mK to 1K, particularly 5 mK to 4K, particularly 5 mK to 10K, particularly 5 mK to 100 K, and more particularly 5 mK to 300K (e.g. room temperature). The temperature ranges can be accessed by a suitable implementation of one or more of the first aspect of FIG. 4, the second aspect of FIG. 5, and the third aspect of FIG. 6. Optionally, a heater such as a resistive heater can be used, in particular to access the higher temperature ranges.

The adiabatic demagnetization apparatus may be configured to change or ramp the target temperature from a first target temperature to a second target temperature or vice versa. Thus, the adiabatic demagnetization apparatus may provide a target temperature gradient over time (i.e., a temperature change rate, e.g., K/min or K/h).

The frequency is varied over time. Thus, the frequency is a temporal frequency which indicates the number of occurrences of a repeating event per unit of time. A cycle is defined as $T_{i,1}\rightarrow T_{i,2}\rightarrow T_{i,1}$ or $T_{i,2}\rightarrow T_{i,1}\rightarrow T_{i,2}$.

According to some embodiments, the adiabatic demagnetization apparatus includes a total number n of adiabatic demagnetization units, wherein $n\geq 1$, 2 or 3. The first aspect of the present disclosure can be applied to a single-stage ADR system (n=1), or may be applied to a multi-stage ADR system ($n\geq 2$). In the multi-stage ADR system, the n adiabatic demagnetization units may be connectable in series to form a chain of adiabatic demagnetization units.

In some implementations, the n adiabatic demagnetization units are connectable in series by thermal switches, which may also be referred to as heat switches. The thermal switch may be a mechanical thermal switch, an electromechanical thermal switch, an electrocaloric thermal switch, a liquid crystal thermal switch, a gas gap thermal switch, a superconducting thermal switch, or a combination thereof.

According to some embodiments, a number m of adiabatic demagnetization units of the n adiabatic demagnetization units is cycled between respective first temperatures and second temperatures, wherein $m\leq n$, in particular wherein $m=n-1$. For example, all adiabatic demagnetization units but the last or $n^{th}$ adiabatic demagnetization unit are cycled between respective first temperatures and second temperatures. The $n^{th}$ adiabatic demagnetization unit may be kept at the target temperature.

An adiabatic demagnetization unit may have an individual first temperature and an individual second temperature. The first temperatures of the adiabatic demagnetization units may be different and/or the second temperatures of the adiabatic demagnetization units may be different. The first temperatures and/or the second temperatures can be selected according to the target temperature, and in particular according to a range of target temperatures to be provided by the adiabatic demagnetization apparatus.

In some implementations, the frequency is varied based on a heat load. The heat load may be a heat load applied to the adiabatic demagnetization apparatus, and in particular to the $n^{th}$ adiabatic demagnetization unit, which may be a last stage of the chain of adiabatic demagnetization units. The last stage can be connected to a sample stage of the adiabatic demagnetization apparatus. The frequency may be increased when the heat load increases. Further, the frequency may be decreased when the heat load decreases.

FIG. 5 shows a time-temperature profile of a multi-stage adiabatic demagnetization refrigerator according to further embodiments of the present disclosure, wherein heat switches of individual ADR units are configured according to a target temperature and/or a heat load.

According to a second aspect of the present disclosure, which can be combined with the first aspect of FIG. 4, a method of controlling an adiabatic demagnetization apparatus includes operating a plurality of thermal switches of the adiabatic demagnetization apparatus in a first switching mode if a first target temperature is set and/or a first heat load is applied; and operating the plurality of thermal switches in a second switching mode if a second target temperature is set and/or a second heat load is applied.

Accordingly, a control of heat switches in response to changes of the target temperature (see FIG. 5) and/or a heat load (not shown) is performed. The allows to provide continuous magnetic cooling even at temperatures far above the optimum operating temperature of the $n^{th}$ adiabatic demagnetization.

The first target temperature may be different from the second target temperature. Additionally, or alternative, the first heat load may be different from the second heat load. The term "heat load" may be defined as an amount of heat required to be removed within a certain period.

In some implementations, the adiabatic demagnetization apparatus is configured to control the target temperature within a predetermined temperature range. The predetermined temperature range may be 5 mK to 0.5K, particularly 5 mK to 1K, particularly 5 mK to 4K, particularly 5 mK to 10K, particularly 5 mK to 100K, and more particularly 5 mK to 300K (e.g. room temperature). The temperature ranges can be accessed by a suitable implementation of one or more of the first aspect of FIG. 4, the second aspect of FIG. 5, and the third aspect of FIG. 6. Optionally, a heater such as a resistive heater can be used, in particular to access the higher temperature ranges.

The adiabatic demagnetization apparatus may be configured to change or ramp the target temperature from the first target temperature to the second target temperature or vice versa.

The first switching mode is different from the second switching mode. The term "switching mode" refers to a change or pattern of a change of a switching state (on/off or closed/open) of the thermal switches.

The plurality of thermal switches may be a total number a of thermal switches, wherein $a \geq 2$. In the first switching mode, a number b of the a thermal switches can be switched according to the recycling rate(s), and a number b' of thermal switches can stay closed ($b+b'=a$). In the second switching mode, a number c of the a thermal switches can be switched according to the recycling rate(s), and a number c' of thermal switches can stay closed ($c+c'=a$; $b \neq b'$; $c \neq c'$). The closed thermal switches may shortcut the respective adiabatic demagnetization unit such that this adiabatic demagnetization unit functions as a passive thermal conductor.

For example, more thermal switches are operated when the target temperature is changed to a lower target temperature and/or when the heat load increases. Thus, a cooling power can be increased by operating more thermal switches.

FIG. 6 shows a time-temperature profile of a multi-stage adiabatic demagnetization refrigerator according to a further embodiment of the present disclosure, wherein the upper and lower operating temperatures $T_{i,1}$ and $T_{i,2}$ of individual ADR units are configured according to the target temperature and/or a heat load (both the target temperature and the heat load may vary as a function of time).

According to a third aspect of the present disclosure, a method of controlling an adiabatic demagnetization apparatus includes cycling at least one adiabatic demagnetization unit of the adiabatic demagnetization apparatus between a first temperature and a second temperature, wherein the first temperature and/or the second temperature is varied or variable. The first temperature is higher than the second temperature. The third aspect can be combined with the first aspect of FIG. 4 and/or the second aspect of FIG. 5.

The method according to the third aspect uses non-constant recycling temperatures $T_{i,1}$ and $T_{i,2}$. Thus, the recycling rates may be reduced according to the target temperature (see FIG. 6) and/or the heat load (not shown).

An adiabatic demagnetization unit may have an individual first temperature and an individual second temperature. The first temperatures of the adiabatic demagnetization units may be different and/or the second temperatures of the adiabatic demagnetization units may be different. The first temperatures and/or the second temperatures of at least one adiabatic demagnetization unit, and in particular of multiple adiabatic demagnetization units, can be changed or non-constant. For example, the first temperatures and/or the second temperatures may be different in at least some of the cycles.

In some implementations, the first temperature and/or the second temperature is varied based on a heat load and/or a target temperature. For example, the first temperature and/or the second temperature may be decreased if the heat load is increased, and/or the first temperature and/or the second temperature may be increased if the target temperature is increased. Additionally, or alternatively, the first temperature and/or the second temperature may be increased if the heat load is decreased, and/the first temperature and/or the second temperature may be decreased if or the target temperature is decreased.

The heat load may be a heat load applied to the adiabatic demagnetization apparatus, and in particular to the $n^{th}$ adiabatic demagnetization unit, which may be a last stage of the chain of adiabatic demagnetization units. The last stage can be connected to a sample stage of the adiabatic demagnetization apparatus.

According to embodiments described herein, the method can be conducted by means of computer programs, software, computer software products and the interrelated controllers, which can have a CPU, a memory, a user interface, and input and output means being in communication with the corresponding components of the adiabatic demagnetization apparatus.

According to an independent aspect of the present disclosure, a (e.g. non-transitory) machine readable medium is provided. The machine readable medium includes instructions executable by one or more processors to implement the embodiments of the method of the present disclosure, and in particular the method of the first aspect and/or the second aspect and/or the third aspect.

The (e.g. non-transitory) machine readable medium may include, for example, optical media such as CD-ROMs and digital video disks (DVDs), and semiconductor memory devices such as Electrically Programmable Read-Only Memory (EPROM), and Electrically Erasable Programmable Read-Only Memory (EEPROM). The machine readable medium may be used to tangibly retain computer program instructions or code organized into one or more modules and written in any desired computer programming language. When executed by, for example, one or more processors such computer program code may implement one or more of the methods described herein.

In one implementation the control of the CADR system may be achieved by means of a state machine which makes use of the status of each individual ADR unit, particularly:

i) a state variable ("state"), e.g., "idle", "waiting", "regenerating", "relaxing", "servo", etc.

ii) the magnetic field B at the position of the cooling medium, iii) the temperature of the cooling medium, and iv) the heat switch status, e.g., "open" or "closed".

A possible implementation of the state machine may be used to control an ADR unit with index i within a magnetic heat pump. For example, the ADR units with indices i−1 and i+1 are referred to as slave and master, respectively. A slightly different control method may be used for the last ADR unit(s) with index n within an n-stage CADR system.

Figure 7:
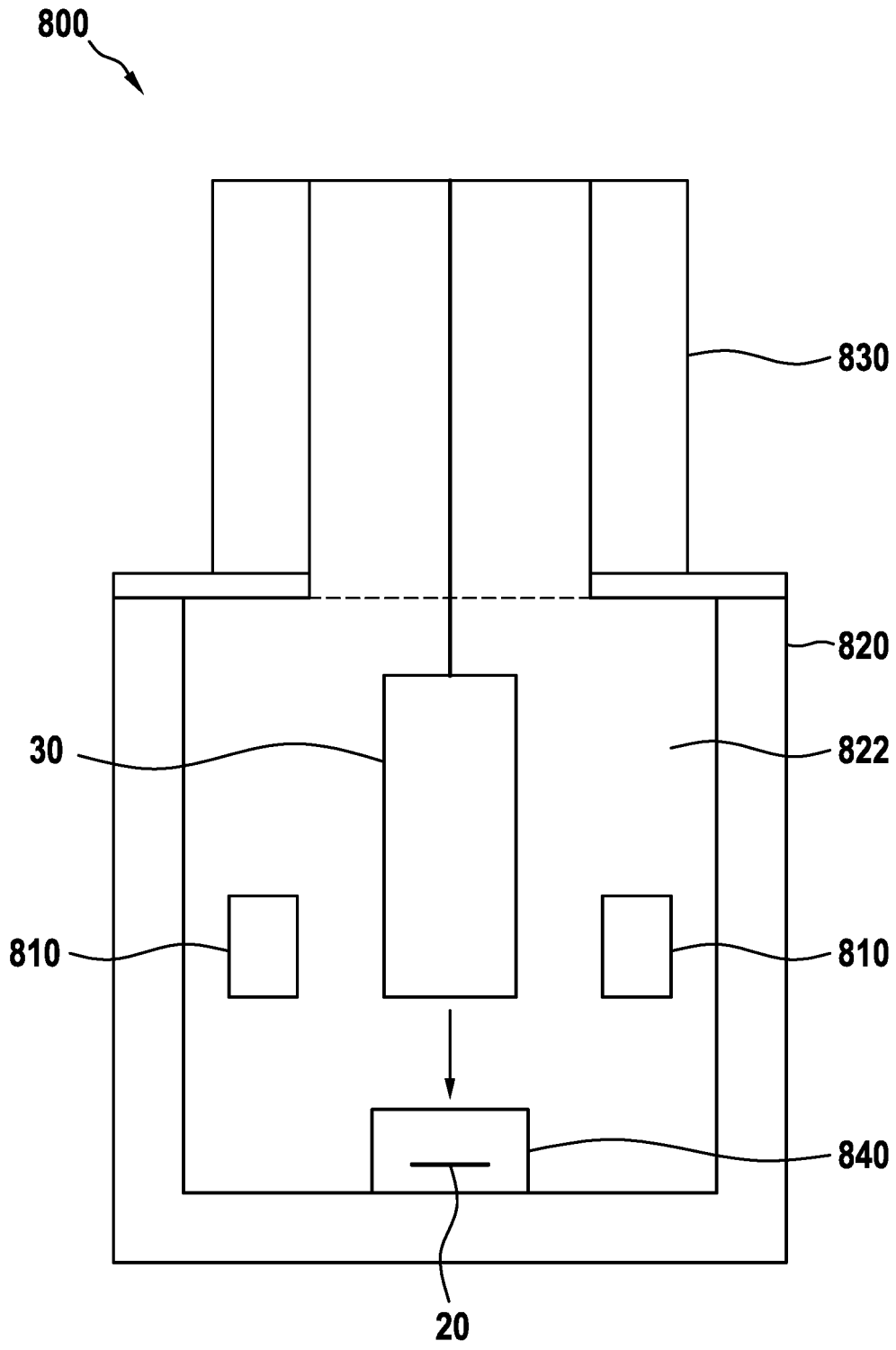
FIG. 7 shows a schematic view of a multi-stage adiabatic demagnetization refrigerator according to embodiments of the present disclosure.

FIG. 7 shows a schematic view of a system 800 having an adiabatic demagnetization apparatus 810 according to the embodiments described herein.

The adiabatic demagnetization apparatus 810 includes a controller which includes one or more processors and a memory coupled to the one or more processors and comprising instructions executable by the one or more processors to implement the embodiments of the method of the present disclosure.

The system 800 can be a cryostat, such as a cryogen-free cryostat. The system 800 includes a vacuum chamber 820 and the adiabatic demagnetization apparatus 810 of the embodiments of the present disclosure.

The vacuum chamber 820 has an interior space 822 which is configured to contain a vacuum. The vacuum chamber 820 seals the interior space 822 from the outside essentially gas-tight, vacuum-tight, heat-impermeable, and/or radiation-impermeable. Optionally, the vacuum chamber 820 may electrically insulate the interior space 822 from the outside.

A vacuum is generally understood as a space essentially devoid of matter. The term "vacuum" as used throughout the present application is in particular understood as a technical vacuum, i.e., a region with a gaseous pressure much less than atmospheric pressure. The vacuum inside the vacuum chamber 820 can be high vacuum or ultra-high vacuum. One or more vacuum generation sources, such as turbo pumps and/or cryo pumps (not shown), can be connected to the vacuum chamber 820 to generate the vacuum.

According to some embodiments, the system 800 may be provided to measure one or more physical characteristics of a sample 20 at low or ultra-low temperatures. The one or more physical characteristics may include, but are not limited to, magnetization, resistivity, and conductivity. Optionally, the one or more physical characteristics of the sample can be measured under external conditions, such as external magnetic fields and/or pressure. The sample 20 may be loaded into the vacuum 820 and unloaded from the vacuum chamber using a sample transfer mechanism 30.

The system 800 may include an access port 830 having an inner space and a vacuum lock. The vacuum lock may seal the interior space 822 from the inner space of the access port 830 essentially vacuum-tight in a closed state, and may allow an access to the interior space 822 in an open state.

For example, the vacuum lock can be closed and a sample holder having the sample 20 attached thereto can be placed in the inner space of the access port 830 e.g. under atmospheric pressure. The inner space of the access port 830 can be sealed from the outside and a technical vacuum can be generated in the inner space. Then, the vacuum lock can be opened to connect the interior space 822 of the vacuum chamber 820 and the inner space of the access port 830. The sample holder can be inserted into the vacuum chamber 820 using the sample transfer mechanism 30. The sample holder can be mechanically attached to a base 840, the sample holder can be released from the sample transfer mechanism 30, and the sample transfer mechanism 30 can be removed from the inner space 822. The vacuum lock can be closed and the system 800 can be operated to examine the sample on the sample holder.

The system 800 can be configured to provide temperatures inside of the vacuum chamber in a range between 5 mK and 300 K, particularly in a range between 5 mK and 250 K, particularly in a range between 5 mK and 200 K, particularly in a range between 5 mK and 150 K, particularly in a range between 5 mK and 100 K, and more particularly in a range between 5 mK and about 70 K. In some implementations, even if the system is a cryostat, temperatures up to room temperature can be provided to conduct measurements on samples. The temperature ranges can be accessed by a suitable implementation of one or more of the first aspect of FIG. 4, the second aspect of FIG. 5, and the third aspect of FIG. 6. Optionally, a heater such as a resistive heater can be used, in particular to access the higher temperature ranges.

According to some embodiments, which can be combined with other embodiments described herein, the system 800 is an adiabatic demagnetization refrigerator, and in particular a multi-stage adiabatic demagnetization refrigerator. The multi-stage adiabatic demagnetization refrigerator may be configured to operate at 1K or below, particularly at 500 mK or below, particularly at 100 mK or below, and particularly at 50 mK or below. However, as mentioned above, the present disclosure is not limited thereto and the system 800 can be operated at higher temperatures, i.e. temperatures of 1K or higher, e.g. up to room temperature.

While the foregoing is directed to embodiments of the disclosure, other and further embodiments of the disclosure may be devised without departing from the basic scope thereof, and the scope thereof is determined by the claims that follow.

The invention claimed is:

1. A method of controlling an adiabatic demagnetization apparatus operating in continuous adiabatic demagnetization refrigeration (CADR) mode, comprising:

providing n adiabatic demagnetization units that provide cooling without the use of liquid cooling media, wherein n is the total number of adiabatic demagnetization units and n is equal or greater than 2;

cycling at least two of the adiabatic demagnetization units of the adiabatic demagnetization apparatus between respective first temperatures and second temperatures with varying cycling frequency, wherein the cycling frequency is varied during the operating of the adiabatic demagnetization apparatus in the CADR mode based on a change of a heat load, and wherein the cycling frequency is increased when the heat load increases and the cycling frequency is decreased when the heat load decreases.

2. The method of claim 1, wherein n≥2 or 3, wherein:

the n adiabatic demagnetization units are connectable in series by thermal switches.

3. The method of claim 1, wherein the cycling frequency is varied based on a heat load applied to a last stage n of the n adiabatic demagnetization units.

4. The method of claim 1, wherein the first temperature is higher than the second temperature.

5. A method of controlling an adiabatic demagnetization apparatus operating in continuous adiabatic demagnetization refrigeration (CADR) mode, the adiabatic demagnetization apparatus providing cooling without the use of liquid cooling media, comprising:

operating a plurality of thermal switches of the adiabatic demagnetization apparatus in a first switching mode if at least one of a first target temperature is set and a first heat load is applied; and in response to at least one of (i) a change of a target temperature from the first target temperature to a second target temperature and (ii) a change of a heat load from the first heat load to a second heat load during the operating of the adiabatic demagnetization apparatus in the CADR mode, operating the plurality of thermal switches in a second switching mode different from the first switching mode.

6. The method of claim 5, wherein the first target temperature is different from the second target temperature.

7. The method of claim 5, wherein the plurality of thermal switches includes a total number a of thermal switches, wherein a≥2.

8. The method of claim 5, wherein:

thermal switches, which are not operated in at least one of the first switching mode and the second switching mode, are closed.

9. The method of claim 5, further comprising one or more processors wherein the method is implemented by a machine readable medium comprising instructions executable by the one or more processors.

10. The method of claim 5, further comprising a controller wherein the method is implemented by the controller, wherein the controller comprises:

one or more processors; and a memory coupled to the one or more processors and comprising instructions executable by the one or more processors.

11. The method of claim 5 wherein the method is implemented in a cryostat.

* * * * *